US006245285B1

(12) United States Patent
Dry et al.

(10) Patent No.: US 6,245,285 B1
(45) Date of Patent: Jun. 12, 2001

(54) TOP INJECTION LANCE

(75) Inventors: Rodney J. Dry, City Beach; Cecil Peter Bates, Mount Pleasant, both of (AU); Ralph M. Weber, deceased, late of Rio De Janeiro (BR), by Margot Weber, legal representative

(73) Assignee: Technological Resources Pty. Ltd., Melbourne (AU)

( * ) Notice: Subject to any disclaimer, the term of this patent is extended or adjusted under 35 U.S.C. 154(b) by 0 days.

(21) Appl. No.: 09/214,179

(22) PCT Filed: Jul. 11, 1997

(86) PCT No.: PCT/AU97/00441

§ 371 Date: Jun. 2, 1999

§ 102(e) Date: Jun. 2, 1999

(87) PCT Pub. No.: WO98/02588

PCT Pub. Date: Jan. 22, 1998

(30) Foreign Application Priority Data

Jul. 12, 1996 (AU) ..... PO0959

(51) Int. Cl.[7] ..... C21C 5/30

(52) U.S. Cl. ..... 266/222; 266/226; 266/268; 266/270

(58) Field of Search ..... 266/222, 226, 266/266, 268, 270, 47

(56) References Cited

U.S. PATENT DOCUMENTS

| | | | |
|---|---|---|---|
| 3,751,019 | 8/1973 | Phillips | 239/132.3 |
| 3,912,244 | 10/1975 | Chang | 239/132.3 |
| 4,022,447 | 5/1977 | Griffiths . | |
| 4,023,676 | 5/1977 | Bennett et al. | 266/222 |
| 4,249,719 * | 2/1981 | Knuppel et al. | 266/47 |
| 4,865,297 | 9/1989 | Gitman . | |
| 4,887,800 * | 12/1989 | Hotta et al. | 266/270 |
| 5,149,261 | 9/1992 | Suwa et al. . | |
| 5,308,043 | 5/1994 | Floyd et al. . | |
| 5,354,940 | 10/1994 | Nagel | 588/201 |
| 5,599,375 * | 2/1997 | Gitman | 75/10.42 |
| 5,788,921 * | 8/1998 | Gitman et al. | 266/225 |

FOREIGN PATENT DOCUMENTS

| | | |
|---|---|---|
| 22448/88 | 5/1989 | (AU) . |
| 24505/92 | 3/1993 | (AU) . |
| 597 270 | 5/1994 | (EP) . |
| WO 91/05214 | 4/1991 | (WO) . |

OTHER PUBLICATIONS

*Derwent Abstract* Accession No. 92–422681.51, Class Q77, SU 1709162 A1 (Doni Coke Chem Wks) Jan. 30, 1992.

* cited by examiner

*Primary Examiner*—Roy King
*Assistant Examiner*—Tima McGuthry-Banks
(74) *Attorney, Agent, or Firm*—Merchant & Gould P.C.

(57) ABSTRACT

A lance (5) for injecting a feed material, preferably a solid feed material, into a metallurgical vessel, is disclosed. The lance comprises: an inlet (21) for introducing the feed material into the lance; an outlet (23) at a forward end of the lance (5) for discharging the feed material from the lance (5); a hollow elongate member (25) that defines a passageway (33) for the feed material between the inlet (21) and the outlet (23) and is adapted to be cooled by a first cooling fluid; and an outer jacket (35) positioned around a section of the length of the member (25) and is adapted to be cooled by a second cooling fluid.

10 Claims, 1 Drawing Sheet

TOP INJECTION LANCE

The present invention relates to a lance.

The present invention relates particularly, although by no means exclusively, to a lance that can be used in a metallurgical vessel on a continuous or batch basis and withstand substantial exposure to molten metal and slag in the vessel that could chemically attack the lance and substantial variations in temperature in the vessel that could contribute to premature mechanical failure of the lance.

The present invention relates more particularly, although by no means exclusively, to a lance that can be used in a range of operational positions to inject solid feed materials into a metallurgical vessel which contains a bath of molten material having a layer of molten metal and a layer of slag with or without a mixture of molten metal and slag. The range of operational positions includes, but is not limited to, positions in which the tip of the lance is:

i. above the bath in a clear or splash zone;

ii. immersed in the slag layer; or iii. immersed in the metal layer.

The present invention relates more particularly, although by no means exclusively, to a method of injecting solid feed materials into a metallurgical vessel that is based on the use of a lance of the present invention.

The present invention relates more particularly, although by no means exclusively, to a lance that can be used to carry out the HIsmelt process for producing molten iron with top injection of solid feed materials, such as coal, iron ore, and fluxes, to penetrate the surface of a bath of molten iron/slag in a metallurgical vessel.

There is a wide range of known lances and tuyeres for injecting solid feed materials into metallurgical vessels for producing ferrous and non-ferrous metals and alloys. The known lances and tuyeres include, by way of example:

i. The SAVARD-LEE bottom tuyere for the injection of oxygen through the refractory lining of metallurgical vessels. The tuyere comprises at least 2 concentric pipes. Typically, in use, oxygen is injected through the inner pipe and hydrocarbons (as coolant) are injected through the annular space(s) between the pipe(s). This type of tuyere is also used for injecting solids entrained in a carrier gas instead of oxygen (Z-Bop, KS, KMS). Kortec AG has patented several particular concentric pipe combinations of the tuyere which, in use, are cooled by hydrocarbon mixtures with water and a carrier gas. These combinations have been used in a wide range of applications. However, in general, the tuyere is sensitive to burn-back and erosion of refractories around the tuyere. Typically, the burn-back velocity (and associated refractory erosion) is between 0.5 and 1.5 mm/hr. This rate of refractory loss limits tuyere life.

ii. Kortec AG has also patented a horizontally or vertically movable tuyere with similar characteristics to the tuyere referred to in item i. The concentric pipes of the tuyere in this case are fixed in a round refractory sleeve and the resultant assembly of the sleeve and the pipes is progressively pushed into a metallurgical vessel to compensate for burn-back. By this method, erosion of refractories is minimised.

iii. Inclined top lances, particularly for electric arc furnace applications, for the injection of oxygen, coal, and other solids. These lances are water cooled and in a furnace operation are moved into a slag layer but are kept away from the molten metal layer to ensure that there is minimal contact with molten metal. Typically, the lances have a limited lifetime of 500–2000 heats (200–800 operational hours) before repairs and maintenance are required.

Other known lances and tuyeres include, but are not limited to Sirosmelt lances, Ausmelt lances and steal pipes (and refractory coated steel pipes) used in the iron and steel industries for injecting gas and solids.

However, notwithstanding the wide range of known lances, the applicant is not aware of a lance that is capable of withstanding substantial exposure to molten iron and substantial long term and continuous temperature variations as would be required in order to be used in the HIsmelt or similar process when operated with top injection of feed materials.

An object of the present invention is to provide a lance that is capable of operating under these conditions.

According to the present invention there is provided a lance for injecting a feed material, preferably a solid feed material, into a metallurgical vessel, which comprises:

i. an inlet for introducing the feed material into the lance;

ii. an outlet at a forward end of the lance for discharging the feed material from the lance;

iii. a hollow elongate member that defines a passageway for the feed material between the inlet and the outlet and is adapted to be cooled by a first cooling fluid; and iv. an outer jacket positioned around a section of the length of the member and is adapted to be cooled by a second cooling fluid.

In use, the jacket and the second cooling fluid that flows through the jacket acts as a shield for the enclosed section of the length of the member and prevents direct damage to this part of the member that could be caused by contact with molten metal and/or slag and minimises adverse effects of high temperature and variations in temperature along the length of the member. In addition, in use, the first cooling fluid that flows through the member protects the member from adverse effects of the high temperature environment:

(i) externally of the member, including where the member extends beyond the jacket at the forward end of the lance; and (ii) internally of the member in situations where the feed material is preheated.

It is preferred, although by no means essential, that the member be tubular.

It is preferred that the member extend beyond the jacket at the forward end of the lance.

It is preferred that the member comprise at least one passageway for the first cooling fluid.

It is preferred that the member comprise an inlet for introducing the first cooling fluid into the cooling fluid passageway and an outlet for discharging heated first cooling fluid from the cooling fluid passageway.

It is preferred that the cooling fluid passageway outlet be in the region of the forward end of the lance.

It is preferred that the cooling fluid passageway be in the form of an annular chamber.

It is preferred that the first cooling fluid comprise a mixture of water and a gas, such as nitrogen or carbon monoxide or argon.

The first cooling fluid may also comprise one or more other gases that, in use, are of benefit in a metallurgical process.

It is preferred that the lance further comprises a means for atomising water in the water/gas mixture.

It is preferred particularly that the atomising means be located at the inlet of the cooling fluid passageway.

It is preferred that the member have two or more of the cooling fluid passageways for the first cooling fluid.

With such an arrangement, it is preferred particularly that the cooling fluid passageways be concentric annular chambers.

It is preferred that the member comprise an outer wall and an inner wall and that one of the annular cooling fluid chambers be between the outer wall and the inner wall.

With such an arrangement, it is preferred that the other or one of the other annular cooling fluid chambers be an annular gap between the outer wall of the member and an inner wall of the jacket.

It is preferred that the lance further comprises a means for supporting the member so that the member can move relative to the jacket in the lengthwise direction of the lance.

It is preferred that the lance further comprises a means for moving the member relative to the jacket to compensate for erosion of the member at the forward end of the lance and thereby maintain initial relative positions of the jacket and the member at the forward end of the lance.

It is preferred that the jacket be positioned around a section of the member that is at the forward end of the lance.

It is preferred that the jacket define a chamber for the second cooling fluid.

It is preferred that the chamber be closed at the forward end of the lance.

It is preferred particularly that the chamber be an annular chamber.

With such an arrangement, it is preferred that the jacket comprises an inlet for introducing the second cooling fluid into the chamber and an outlet for discharging heated second cooling fluid from the chamber.

It is preferred that the lance comprises a means for regulating the flow rate of the second cooling fluid to the chamber inlet. It is preferred particularly that in use of the lance the flow rate be regulated to form and maintain a freeze layer of molten metal/slag on the outer surface of the jacket.

It is preferred that the second cooling fluid be water.

According to the present invention there is provided a method of injecting solid feed materials into a metallurgical vessel containing a bath of molten metal and slag which method comprises:

i. positioning the lance as described above in the metallurgical vessel to operate selectively in a range of operational positions which include:
   a. above the bath in a clear or splash zone;
   b. immersed in a slag layer in the bath; and
   c. immersed in a metal layer in the bath.
ii. injecting the fed material to the bath via the passageway of the member of the lance;
iii. supplying a first cooling fluid to the member; and
iv. supplying a second cooling fluid to the jacket of the lance so that the jacket and the second cooling fluid form a shield for the enclosed section of the length of the member.

BRIEF DESCRIPTION OF THE DRAWINGS

The present invention is described further with reference to the accompanying drawings of which.

Figures 1, 2:
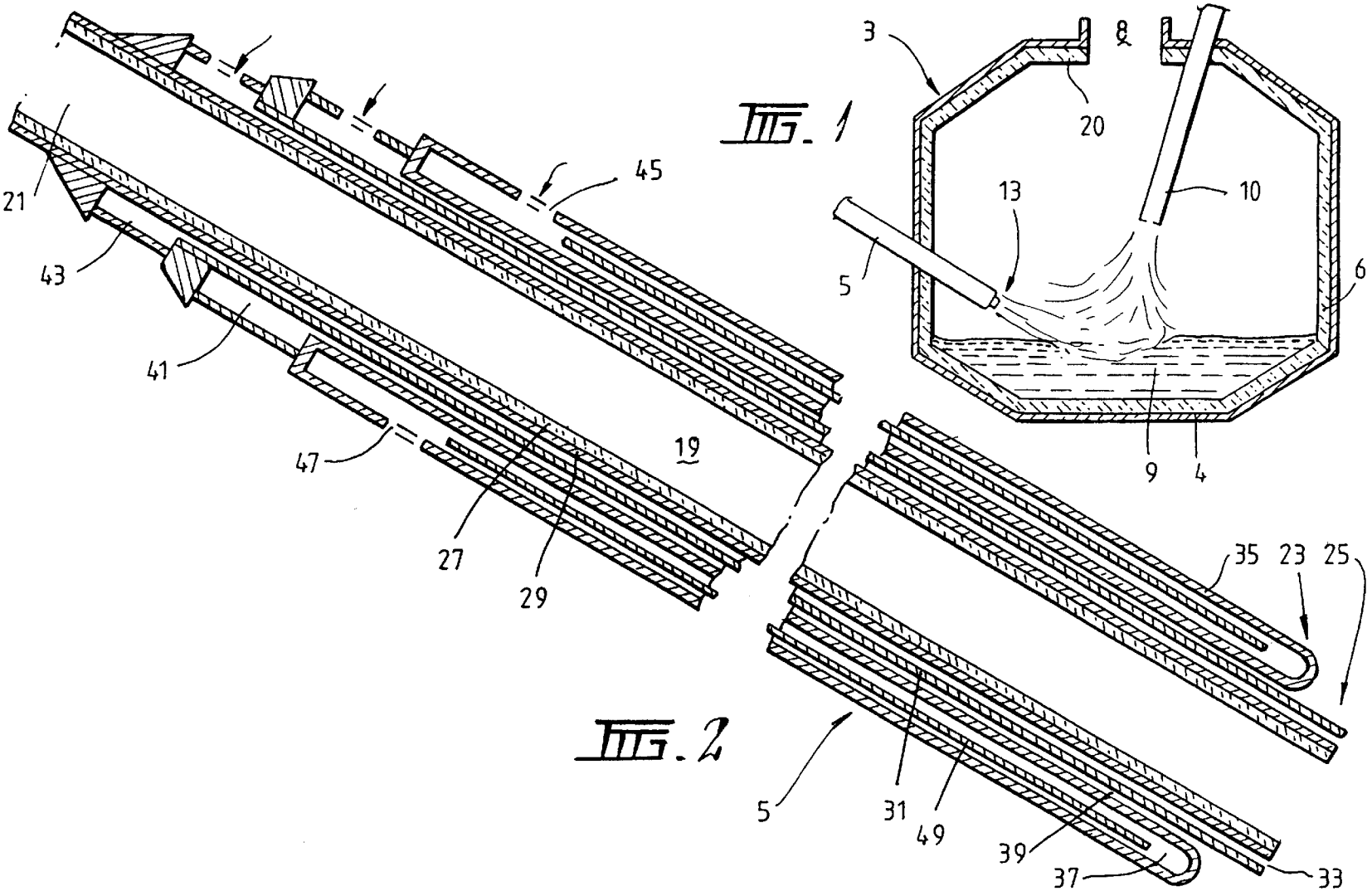
FIG. 1 is a sketch illustrating a metallurgical vessel with a top injection lance extending through a side wall of the vessel.
FIG. 2 is a vertical section through a preferred embodiment of a top injection lance in accordance with the present invention.

The following description is in the context of smelting iron ore to produce molten iron and it is understood that the present invention is not limited to this application and is applicable generally to the production of ferrous and non-ferrous metals and alloys in metallurgical vessels.

FIG. 1 illustrates, albeit in simplified schematic form, one possible embodiment of an apparatus for smelting iron ore in accordance with the HIsmelt process when operated with top injection of solid feed materials.

The apparatus comprises a metallurgical vessel 3 having a metal shell and a lining of refractory material which is adapted to retain a bath 9 of molten material comprising layers of molten iron and slag and mixtures of molten iron and slag. The vessel 3 comprises a bottom 4, a cylindrical side wall 6, a roof 20 and a gas outlet 8.

The apparatus also comprises a lance 5 for injecting solid feed materials, such as iron ore (including pre-reduced iron ore), coal, and flux, in a hot or cold state, entrained in a suitable transport gas, such as air, nitrogen, or natural gas into the bath 9. The lance 5 is arranged to extend through the side wall 6 of the vessel 3 and can be positioned in a range of operational positions, including the position shown in FIG. 1 in which a tip portion 13 of the lance 5 is a short distance above the surface of the bath 9. Other operational positions, which include submerging the tip portion 13 in the slag layer and in the slag/metal layers, can be adopted.

The apparatus further comprises a top lance 10 for injecting oxygen-containing gas into the vessel 3. The lance 10 is positioned to extend through the roof 20 of the vessel.

Typically, in use, the vessel 3 will contain temperature zones varying from 1450° C.–2000° C. Specifically, in order to function over the range of operational positions noted above, in use, the lance 5 would have to withstand temperatures of the order of 1500° C. in the bath 9 and up to 2000° in the gas space above the bath 9.

With reference to FIG. 2, the lance 5 comprises an inlet end 21 for introducing solid feed materials into the lance 3 and an outlet end 23 for discharging the solid feed materials from the lance 5.

The lance 5 also comprises a hollow elongate tubular member, generally identified by the numeral 25, that defines a central passageway 19 that extends along the length of the lance 5 between the inlet end 21 and the outlet end 23. The outlet end 23 forms the forward end of the lance 5.

In use, solid feed materials entrained in a suitable transport gas flow along the passageway 19 from the inlet end 21 and are discharged from the outlet or forward end 23 of the lance 5.

The tubular member 25 comprises 3 concentric tubes, with an inner tube 27 formed from a ceramic material and an intermediate tube 29 and an outer tube 31 formed from stainless steel.

The tubular member 25 is formed so that there is an annular gap between the intermediate tube 29 and the outer tube 31, and the gap defines an annular passageway 33 for a cooling fluid in the form of a mixture of atomised water and a gas, such as nitrogen, carbon monoxide, or argon.

The lance 5 further comprises a water-cooled outer jacket 35 that is positioned around a section of the length of the tubular member 25 in the region of the forward or outlet end 23 of the lance 5.

The jacket 35 is formed so that there is an annular gap between the tubular member 25 and the jacket 35, and the gap defines another annular passageway 39 for the atomised water/gas mixture.

The lance 5 further comprises manifold chambers 41, 43 which define inlets for the atomised water/gas mixture to the cooling fluid passageways 33, 39. In use, the atomised water/gas mixture that is injected via the manifold chambers 41, 43 flows along the passageways 33, 39 and is discharged at the forward or outlet end 23 of the lance 5.

The jacket 35 is formed from stainless steel and defines an annular chamber 37. The forward end of the chamber 37 is closed. The jacket 35 comprises an inlet 45 for cooling water and an outlet 47 for heated cooling water in diametrically opposed sections of the jacket 35 that are distal from the forward or outlet end 23 of the lance 5. In use, cooling water that is injected via the inlet 45 flows through the chamber 37 and is discharged as heated water from the outlet 47.

The jacket 35 further comprises an annular tube 49 positioned in the chamber 37 to divide the chamber 37 into inner and outer regions. The purpose of the tube 49 is to optimise heat transfer to the cooling water.

The lance 5 is formed so that the tubular member 25 is slidable relative to the jacket 35. This feature is provided to allow the tubular member 25 to be moved progressively toward the forward or outlet end 23 of the lance 5 to maintain the relative positions of the tubular member 25 and the jacket 35 as shown in FIG. 2. This is necessary to compensate for the progressive wearing away of the tubular member 25 at the forward or outlet end 23 of the lance 5 which is an inevitable outcome of the use of the lance 5 in the metallurgical vessel 3.

The applicant has found in trials of the lance 5 described above in a metallurgical vessel 3 containing a bath 9 of a molten iron and slag that the lance 5 could effectively withstand the environment of the vessel 3.

Many modifications may be made to the preferred embodiment of the lance 5 described above without departing from the spirit and scope of the present invention.

What is claimed is:

1. A lance for injecting a feed material into a metallurgical vessel, the lance comprising:

i. an inlet for introducing the feed material into the lance;

ii. an outlet at a forward end of the lance for discharging the feed material from the lance;

iii. an outer cooling jacket extending to the forward end of the lance;

iv. a hollow elongate member that defines a passageway for the feed material between the inlet and the outlet and including at least two cooling fluid passageways for a first cooling fluid, each cooling fluid passageway having an inlet for the first cooling fluid and an outlet for discharging the first cooling fluid at the forward end of the lance, and one of the cooling fluid passageways being in the form of an annular gap between an outer wall of the member and an inner wall of the outer jacket, and wherein the member extends beyond the outer jacket at the forward end of the lance; and v. means for supporting the member so that the member can move relative to the outer jacket in a lengthwise direction of the lance.

2. The lance defined in claim 1 wherein the first cooling fluid includes a mixture of water and a gas.

3. The lance defined in claim 2 further including means for atomising water in the water/gas mixture, said means located at the inlet of each cooling fluid passageway.

4. The lance defined in claim 1 wherein one of the cooling fluid passageways comprises an annular gap formed between an inner wall and the outer wall of the member.

5. The lance defined in claim 1 further including means for moving the member relative to the outer jacket to compensate for erosion of the member at the forward end of the lance and thereby maintaining initial relative positions of the outer jacket and the member at the forward end of the lance.

6. The lance defined in claim 1 wherein the outer jacket defines a chamber for a second cooling fluid.

7. The lance defined in claim 6 wherein the chamber is closed at the forward end of the lance.

8. The lance defined in claim 6 wherein the chamber is an annular chamber.

9. The lance defined in claim 6 wherein the outer jacket includes an inlet for introducing the second cooling fluid into the chamber and an outlet for discharging the second cooling fluid from the chamber.

10. The lance defined in claim 9 further including means for regulating the flow rate of the second cooling fluid to the chamber inlet.

* * * * *